US005538182A

United States Patent [19]

Davis et al.

[11] Patent Number: 5,538,182

[45] Date of Patent: Jul. 23, 1996

[54] RAILROAD CROSSING SYSTEM

[75] Inventors: R. Andrew Davis, Portland; Bryan Holland, Tualatin; Jack Williams, Portland, all of Oreg.

[73] Assignee: Omni Products, Inc., Portland, Oreg.

[21] Appl. No.: 428,724

[22] Filed: Apr. 25, 1995

[51] Int. Cl.[6] ..... E01B 2/00

[52] U.S. Cl. ..... 238/8; 238/7; 238/265

[58] Field of Search ..... 238/2, 6, 7, 8, 238/9, 265, 349, 351

[56] References Cited

U.S. PATENT DOCUMENTS

| | | | |
|---|---|---|---|
| 2,789,771 | 4/1957 | Bishop | 238/9 |
| 3,317,137 | 5/1967 | Harmon | 238/8 |
| 4,641,779 | 2/1987 | O'Brien et al. | 238/8 |
| 4,899,933 | 2/1990 | Martin | 238/8 |
| 4,911,360 | 3/1990 | Spurr | 238/8 |
| 5,181,657 | 1/1993 | Davis | 238/8 |

OTHER PUBLICATIONS

Product catalog and attached detailed drawing of AMCOR Division—Utility Vault Co. (2 pages), Nov. 1993.

*Primary Examiner*—S. Joseph Morano
*Attorney, Agent, or Firm*—Chernoff, Vilhauer, et al.

[57] ABSTRACT

A railroad grade crossing system includes an integral concrete pad that has a pair of spaced-apart cavities located in its upper surface. The cavities have planar bottom surfaces that support rails with their heads flush with the top surface of the pad. The cavities have outer side walls that conform to the shape of the rails. The rails are placed in the cavities against the outer side walls and are secured in place by a rail anchor system. The remainder of the cavities are filled with elastomeric liners that have outer side walls that are shaped to conform to the shape of the rails. The inserts are held in place in the cavities by frictional engagement between bulbous gripping heads, secured to anchors located in the pads, that frictionally interfit into conforming holes located in the inserts.

5 Claims, 2 Drawing Sheets

RAILROAD CROSSING SYSTEM

BACKGROUND AND SUMMARY OF THE INVENTION

This invention relates to railroad grade crossings, and in particular to railroad grade crossings using both concrete and rubber elements.

In high traffic areas, such as downtown city streets, concrete is the preferred material for railroad grade crossings due to its resistance to wear. In order to reduce the cost and disruption resulting from maintenance, it has become common in this type of environment to provide precast concrete pads which serve both as the crossing and support the rails. The use of these pads eliminates the need for ties and ballast which require periodic maintenance. In order to facilitate the installation and replacement of the rails, the portion of the crossing between the rails is not an integral part of the pads but comprises removable concrete gauge panels. Crossing pads of this type are disclosed in Harmon, U.S. Pat. No. 3,317,137, and in O'Brien, et al., U.S. Pat. No. 4,641,779.

However, the prior art concrete pad grade crossing systems have several shortcomings. Because the concrete gauge panels extend one-half of the distance between the rails they are quite heavy and require the use of a crane to install and remove them. In addition, the prior art concrete gauge panels are attached to the concrete pad by placing bolts through counterbores in the panels and into engagement with threaded anchors embedded in the pad. Aligning the holes in the gauge panels with the anchors in order to start the bolts is difficult, and the process of starting and tightening a large number of bolts is very labor intensive. In addition, all of these bolts need to be loosened and removed to remove the gauge panels whenever maintenance is required.

While concrete crossing elements wear well there are advantages to rubber crossing elements, at least adjacent to the rails. Due to slight irregularities in the rail gauge, concrete gauge panels need to be shimmed in order to provide a tight fit against the rails. In addition, concrete panels will not seal against the rails as well as rubber panels and water will get between the panels and the rails which can weaken the foundation support and can cause damage when it freezes. Rubber panels also provide a smoother transition between the rail and grade crossing for vehicular traffic and are less likely to chip on the upper corners adjacent to the rails.

Composite concrete/rubber grade crossings are known in the prior art. However, these systems are all of the type where the rails are supported by ties and the concrete panels only serve as crossing elements not rail supporting pads. In Davis, U.S. Pat. No. 5,181,657, rubber crossing panels are placed on each side of the rails to provide a smooth transition and seal between the rails and the concrete panels that extend across the remainder of the crossing. With this system the concrete panels hold the rubber panels against the rails and on the ties. Thus, Davis, et al. does not address the problems associated with the prior art integral concrete pad crossing systems. Martin, U.S. Pat. No. 4,899,933, provides rubber seals between the rails and the concrete panels that make up the majority of the crossing. These seals are small and are held in place merely by friction. Thus, these seals do not really serve as a part of the crossing. Martin also does not address the problems associated with the prior art integral concrete pad crossing systems.

The subject invention solves the problems associated with the prior art integral concrete pad grade crossing systems by providing an integral rigid grade crossing pad having a pair of cavities defined in it to receive the rails. Each cavity has a planar bottom which supports the bottom flange of a rail, and a first side wall that conformingly contacts the field side of the rail. The rails are located in the respective cavities with their field side walls in contact with the cavity side walls and are secured to the pad with a rail anchor system. Preferably, the rails are wrapped in an electrically non-conductive elastomeric boot to electrically insulate and cushion them with respect to the pad. In a preferred embodiment of the invention the rail anchor system includes a clip having a first portion that partially overlies the rail flange and a second portion that contacts the bottom of the cavity. A bolt extends through a hole in the clip into threaded engagement with an insert embedded in the pad. Thus, by tightening the bolt the clip is clamped against the rail flange and the bottom of the cavity.

The remainder of each cavity is filled with an elastomeric insert which has the same depth as the cavity. One side of the insert conforms to the gauge side of the rail and the other side conforms to the inner side wall of the cavity. A notch located on the upper corner of the insert adjacent to the rail accommodates the flanges of the rail car wheels passing over the rails. The insert is releasably secured to the pad by an insert anchor system.

In a preferred embodiment of the invention the insert anchor system includes bulbous gripping heads that are attached to threaded anchors imbedded in the pad. The inserts contain aligned openings that conform to the shape of the gripping heads. Thus, the inserts can easily be secured to the pad simply by placing them in the cavity and urging them downwardly so that the gripping heads become frictionally engaged in their respective openings in the inserts. The inserts can be removed merely by pulling them away from the pad to disengage the gripping heads from the openings and then lifting them out of the cavities.

The foregoing and other objectives, features, and advantages of the invention will be more readily understood upon consideration of the following detailed description of the invention, taken in conjunction with the accompanying drawings.

DETAILED DESCRIPTION OF A PREFERRED EMBODIMENT

Figure 1:
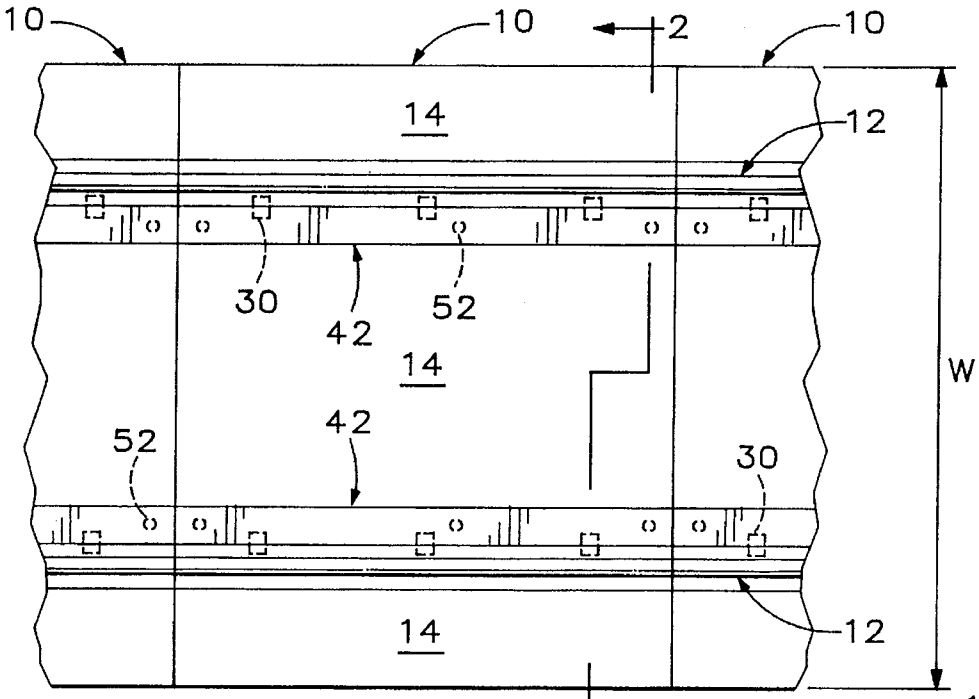
FIG. 1 is a fragmentary plan view of a railroad grade crossing system embodying the subject invention.
Figure 2:
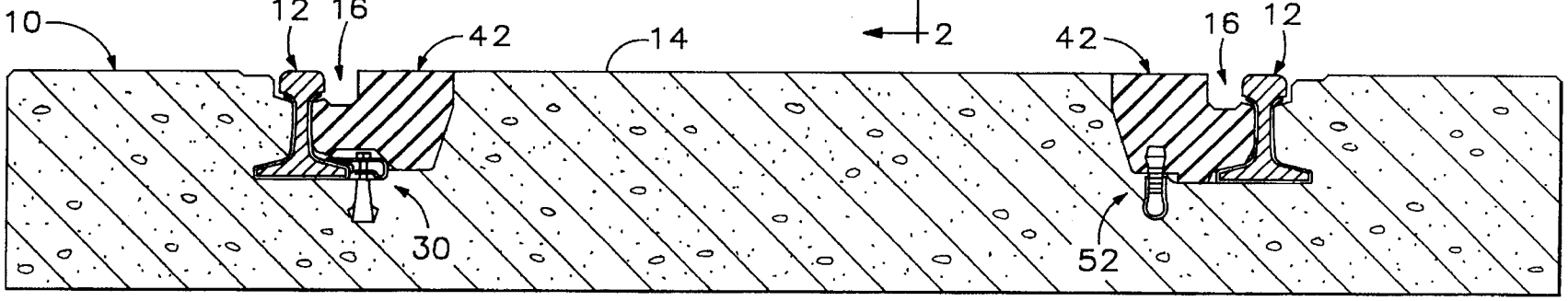
FIG. 2 is a sectional view, at an enlarged scale, taken along the line 2—2 in FIG. 1.

Referring to FIGS. 1–4 of the drawings, a preferred embodiment of the rail crossing system embodying the subject invention includes an integral concrete pad 10 having a width which is greater than the distance between the rails 12 that are being crossed. Located centrally in the top surface 14 of the pad are a pair of elongate parallel cavities 16 that extend across the entire length of the pad. Each cavity has an outer side wall 18 that has the same shape as the outer, or field, side wall 20 of the rails 12. The cavities are positioned such that when the rails are in contact with the cavity outer side walls 18 they have the proper spacing between them. Each cavity has a planar bottom surface 22 over most of its width which supports the flange 24 of the rail with the top surface of the rail head 26 being level with the pad top surface 14. A raised shelf 28 is located at the bottom of the rest of the cavity.

The rails are encased in elastomeric, electrically non-conductive boots 66. Boots of this type are well known and are disclosed in O'Brien, et al., U.S. Pat. No. 4,641,779. The boots provide a seal between the rails and the crossing elements to prevent water from getting below the rails. The boots also provide a cushion between the rails and crossing elements to reduce the amount of vibration that is transmitted to the crossing elements.

Figure 3:
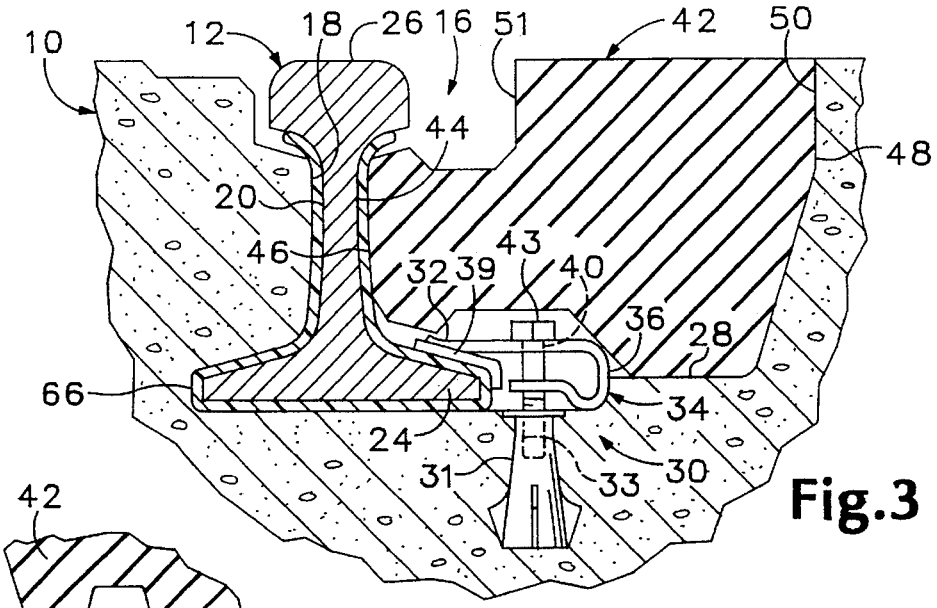
FIG. 3 is a fragmentary sectional view showing how a rail is secured to the crossing pad.
Figure 5:
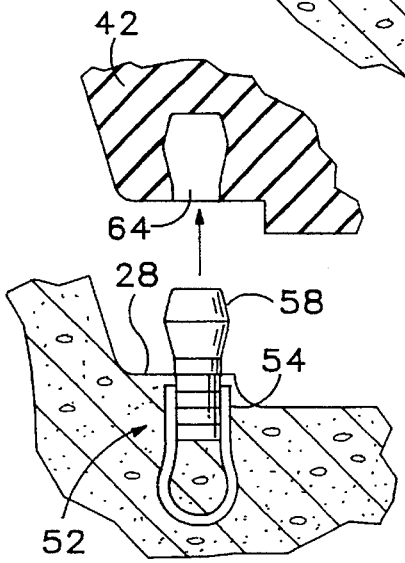
FIG. 5 is a detail sectional view of the pad attachment system.
Figure 6:
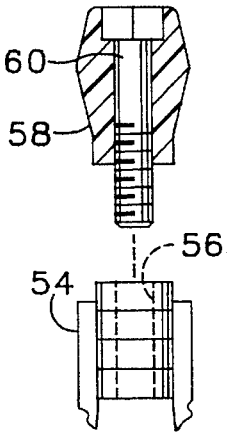
FIGS. 6 and 7 are detail sectional views of two different embodiments of a portion of the pad attachment system.
Figure 7:
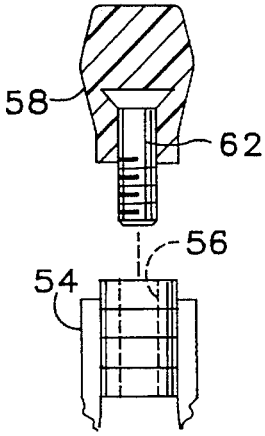
Figure 4:
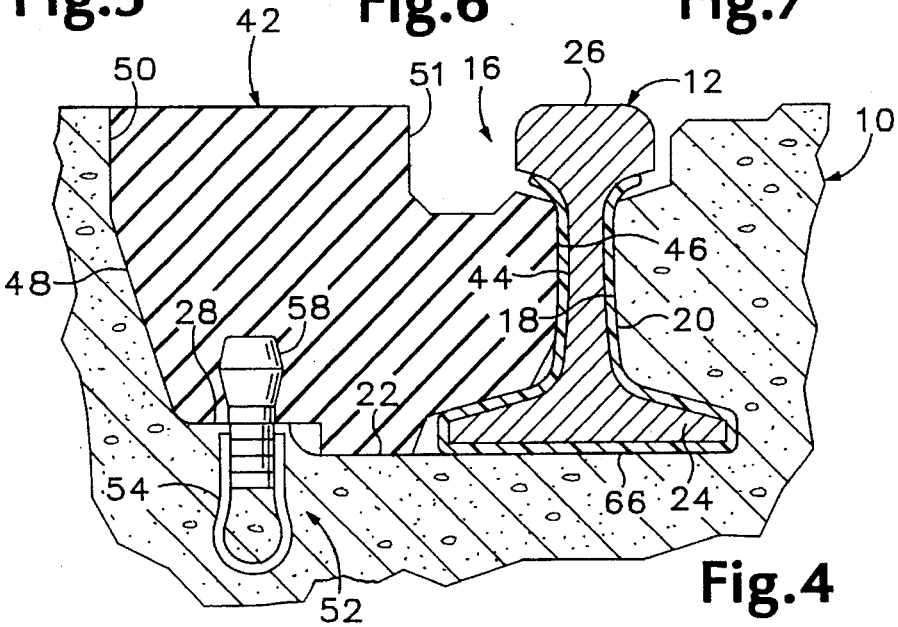
FIG. 4 is a fragmentary sectional view showing how a rubber insert that is part of the crossing system is attached to the crossing pad.

Each rail 12 is secured in its cavity 16 by a rail anchor system 30, FIG. 3. The anchor system utilizes a plurality of clips 34 that secure the rail to the pad at spaced-apart intervals. One end 32 of each clip overlies one side of the rail flange 24 and the other end is bent back toward itself to provide a spring 36 that contacts the cavity bottom surface 22 at its intersection with the shelf 28. An insulation tab 39 is placed between the clips and the rail. A hole 40 extends through the clip intermediate its ends. Concrete anchors 31 having threaded holes 33 in them are embedded in the pad when it is cast at spaced-apart intervals along the bottom surface 22 in alignment with the holes 40 of the clips 34. Burke Hi-Tensile Inserts (404) NO-035 have been found to work well for this purpose. Bolts 43 extend through the holes 40 into threaded engagement with the concrete anchors 31. When the bolts are tightened they clamp the clips against the rail flange and cavity bottom surface to secure the rail to the pad.

Located in each cavity 16 is an elastomeric insert 42. The preferred material for the insert is rubber, and it can be made economically from comminuted rubber according to a number of different known processes that join the rubber particles into a solid rubber element. The insert completely fills the space between the inner side wall 44 of the rail and the inner side wall 50 of the cavity. The outer end wall 46 of the insert conforms to the shape of the gauge side wall of the rail and the inner end wall 48 of the insert conforms to the shape of the inner side wall 50 of the cavity. The insert has the same height as the rail so that its upper surface is coplanar with the upper surface of the pad. The upper corner of each insert next to the rail has a notch 51 formed in it to receive the flange of a rail car wheel passing over the rail.

Each insert is releasably secured to the pad by an insert anchor system 52, FIGS. 4–7. Concrete anchors 54 having threaded openings 56 are embedded in the pad at spaced-apart intervals along the shelf 28. Burke Ferrule Loop Inserts (405) GW-108 have been found to work well for this purpose. A bulbous gripping head 58, made from metal or a hard plastic, is attached to each anchor 54. The gripping head can be attached to the anchor by drilling and counterboring the gripping heads and inserting a bolt 60 through it, FIG. 6, or by embedding a bolt 62 in the gripping head itself, FIG. 7. Located in the bottom surface of the insert above each gripping head is an opening 64 that conforms to the shape of the gripping head. Thus, by placing the insert into the cavity and urging it downwardly the gripping heads 58 are forced into the openings 64 and become frictionally secured therein. This holds the insert in place in the cavity.

In use a sufficient number of pads to span the width of the roadway being crossed are placed side-by-side in the conventional manner. The rails 12 are then placed into the boots and placed on the bottom surface 22 of the pads 10 with their field side walls 20 in contact with the outer side walls 18 of the cavities. The clips 34 are placed over the rail flanges 24 and the bolts 43 inserted through the holes 40 in the clips and threaded into the anchors 31. The bolts are tightened against the clips which causes the rails to be secured in the pad.

Once the rails are installed, the gripping heads are mounted on the anchors 54 and the inserts 42 placed in the cavity 16. By urging the inserts down into the cavities the gripping heads are forced into the openings 64 in the inserts to hold the inserts in place. Due to the size of the inserts they can be placed in the cavities by a couple of workers without the need for a crane. Also, since they do not have to be bolted in place they can be installed quickly and easily. Likewise, they can easily be removed for performing maintenance on the rails simply by pulling the inserts off of the gripping bolts and lifting them out of the cavities.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A railroad grade crossing system comprising:

(a) a pair of parallel rails, said pair of rails being spaced apart at a first width;

(b) an integral rigid pad having a second width greater than the first width, said pad having a pair of cavities defined therein, said cavities each having a depth substantially equal to the height of the rails, a planar bottom surface which supports a rail bottom flange, a first side wall which conforms to the shape of a rail side wall, and a second side wall which is spaced apart from said first side wall;

(c) each rail of said pair of rails having a flange which rests on the bottom surface of one of said cavities, a field side wall which rests against the first side wall of said cavity and an opposed gauge side wall;

(d) a rail anchor system for securing said rails to said pad;

(e) a pair of elastomeric inserts each of said pair having a depth substantially equal to the depth of said cavities, a first end wall which conforms to the rail gauge side wall, a second end wall that conforms to the second side wall of said cavity, and a notch adjacent the upper end of the rail to accommodate a wheel rolling on an adjacent one of said rails; and (f) an insert anchor system for releasably securing said inserts to said pad.

2. The grade crossing system of claim 1 including thin, electrically non-conductive elastomeric boots that covers those portions of the rails that are in contact with said pad or said inserts.

3. The grade crossing system of claim 1 wherein said rail anchor system comprises:

(a) at least one anchor having a threaded opening located therein, said anchor being embedded in said pad;

(b) at least one clip, having a hole defined therein, a first portion which partially overlies the rail flange and a second portion which contacts said bottom surface of said cavity; and (c) at least one bolt which fits through said hole and into threaded engagement with said anchor so as to clamp said clip against said flange and said bottom surface when said bolt is tightened.

4. The grade crossing system of claim 3 wherein said second portion of said clip is a spring.

5. The grade crossing system of claim 1 wherein said insert anchor system comprises:

(a) at least one anchor having a threaded opening located therein, said anchor being embedded in said pad;

(b) at least one bulbous gripping head having a threaded rod protruding therefrom that threadingly engages said threaded opening; and (c) said insert having an opening defined therein that is contoured to frictionally engage said gripping head when said insert is urged downwardly into said cavity.

* * * * *